US009704433B2

(12) United States Patent
Kim

(10) Patent No.: US 9,704,433 B2
(45) Date of Patent: Jul. 11, 2017

(54) ORGANIC LIGHT EMITTING DISPLAY AND METHOD FOR DRIVING THE SAME

(71) Applicant: Samsung Display Co., Ltd., Yongin (KR)

(72) Inventor: Keum Nam Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 13 days.

(21) Appl. No.: 14/712,411

(22) Filed: May 14, 2015

(65) Prior Publication Data

US 2016/0180775 A1 Jun. 23, 2016

(30) Foreign Application Priority Data

Dec. 18, 2014 (KR) ..... 10-2014-0183045

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0262* (2013.01); *G09G 2320/0223* (2013.01); *G09G 2320/0233* (2013.01); *G09G 2320/043* (2013.01)

(58) Field of Classification Search
CPC . G09G 3/3291; G09G 5/18; G09G 2300/0426
See application file for complete search history.

(56) References Cited

U.S. PATENT DOCUMENTS

| | | | | |
|---|---|---|---|---|
| 7,755,585 | B2 | 7/2010 | Kim | |
| 8,237,634 | B2 | 8/2012 | Kwak | |
| 8,570,249 | B2 | 10/2013 | Han | |
| 2010/0013816 | A1* | 1/2010 | Kwak | G09G 3/3233 345/211 |
| 2011/0095967 | A1* | 4/2011 | Choi | G09G 3/3233 345/76 |

(Continued)

FOREIGN PATENT DOCUMENTS

| | | |
|---|---|---|
| KR | 10-2005-0049827 | 5/2005 |
| KR | 10-2010-0009219 | 1/2010 |

(Continued)

*Primary Examiner* — Premal Patel
(74) *Attorney, Agent, or Firm* — H.C. Park & Associates, PLC

(57) ABSTRACT

An organic light emitting display and associated method includes: initializing a first node of a storage capacitor, connected between the first node and a second node, with a first driving voltage that is provided from a first power terminal; applying a sustain voltage to the first node and placing a driving transistor in a diode connection state, wherein the driving transistor comprises a gate electrode connected to the second node, an electrode connected to the first power terminal, and another electrode connected to an organic light emitting diode through a third node; applying a data signal, provided from the data line through a switching transistor comprising a gate electrode connected to a scan line, an electrode connected to the data line, and another electrode connected to a first node, to the first node; and generating a compensation voltage by applying the first driving voltage to the first node.

22 Claims, 9 Drawing Sheets

(56) References Cited

U.S. PATENT DOCUMENTS

| | | | | |
|---|---|---|---|---|
| 2011/0227885 | A1* | 9/2011 | Chung | G09G 3/3241 345/204 |
| 2013/0249883 | A1* | 9/2013 | Hwang | G09G 3/003 345/212 |

FOREIGN PATENT DOCUMENTS

| | | |
|---|---|---|
| KR | 10-2011-0041138 | 4/2011 |
| KR | 10-2011-0045228 | 5/2011 |

* cited by examiner

ORGANIC LIGHT EMITTING DISPLAY AND METHOD FOR DRIVING THE SAME

CROSS-REFERENCE TO RELATED APPLICATIONS

This application claims priority from and the benefit of Korean Patent Application No. 10-2014-0183045, filed on Dec. 18, 2014, which is hereby incorporated by reference for all purposes as if fully set forth herein.

BACKGROUND

Field

Exemplary embodiments relate to an organic light emitting display and a method for driving the same.

Discussion

An organic light emitting display displays an image using organic light emitting diodes (hereinafter referred to as "OLEDs") that emit light through recombination of electrons and holes. The organic light emitting display has the advantages of a rapid response speed, high luminance, large viewing angle, and low power consumption.

The organic light emitting display controls an amount of current that is provided to the organic light emitting diodes using driving transistors included in respective pixel units, and the organic light emitting diodes generate light having specific luminance according to the amount of current provided thereto. However, as the number of transistors that are actually driven in a plurality of pixel units becomes larger, the impedance due to the transistors increases, causing current consumption to increase. Accordingly, driving voltages are reduced according to internal resistance of voltage lines that transfer the driving voltages.

Further, in the organic light emitting display, driving current that is provided to the organic light emitting diode in each of the pixels may differ depending on deviation of threshold voltage Vth of the particular driving transistor coupled to the organic light emitting diode for a particular pixel. Accordingly, even in the case of applying the same data voltage, the organic light emitting diode in each of the pixels may not have the same luminance.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide an organic light emitting display and driving method of the same, which can produce more uniform luminance.

Additional aspects will be set forth in the detailed description which follows, and, in part, will be apparent from the disclosure, or may be learned by practice of the inventive concept.

According to exemplary embodiments, an organic light emitting display includes data lines, scan lines, a pixel unit corresponding to the data lines and the scan lines, and a power supply unit comprising a first power terminal configured to supply a first driving voltage, a second power terminal configured to supply a second driving voltage, and a sustain power terminal configured to supply a sustain voltage to the pixel unit. A pixel unit includes a switching transistor comprising a gate electrode connected to a scan line, an electrode connected to a data line, and another electrode connected to a first node, a storage capacitor comprising a terminal connected to the first node and another terminal connected to a second node, a driving transistor comprising a gate electrode connected to the second node, an electrode connected to the first power terminal, and another electrode connected to an organic light emitting diode through a third node, a first transistor comprising an electrode connected to the second node and another electrode connected to the third node, a second transistor comprising an electrode connected to the first node and another electrode connected to the sustain power terminal, and a third transistor comprising an electrode coupled to the first node and another electrode coupled to the first power terminal.

According to exemplary embodiments, an organic light emitting display includes data lines, scan lines, a pixel unit corresponding to the data lines and the scan lines, and a power supply unit comprising a first power terminal configured to supply a first driving voltage, a second power terminal configured to supply a second driving voltage, and a sustain power terminal configured to supply a sustain voltage to the pixel unit. A pixel unit includes a switching transistor configured to apply a data signal to a first node according to a scan signal, a storage capacitor, connected between the first node and a second node, configured to be charged with a difference voltage of voltages applied to the first and second nodes, a driving transistor configured to control an amount of current provided from the first power terminal to an organic light emitting diode according to voltage applied to the second node, a first transistor configured to provide a signal path between the second node and a third node coupled to an electrode of the driving transistor based on a first control signal, a second transistor configured to apply a sustain voltage to the first node based on the first control signal, and a third transistor configured to apply a driving voltage provided from the first power terminal to the first node according to a second control signal.

According to exemplary embodiments, a method for driving an organic light emitting display includes initializing a first node of a storage capacitor, connected between the first node and a second node, with a first driving voltage that is provided from a first power terminal, applying a sustain voltage to the first node and placing a driving transistor in a diode connection state, wherein the driving transistor comprises a gate electrode connected to the second node, an electrode connected to the first power terminal, and another electrode connected to an organic light emitting diode through a third node, applying a data signal, provided from the data line through a switching transistor comprising a gate electrode connected to a scan line, an electrode connected to the data line, and another electrode connected to a first node, to the first node, and generating a compensation voltage by applying the first driving voltage to the first node.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
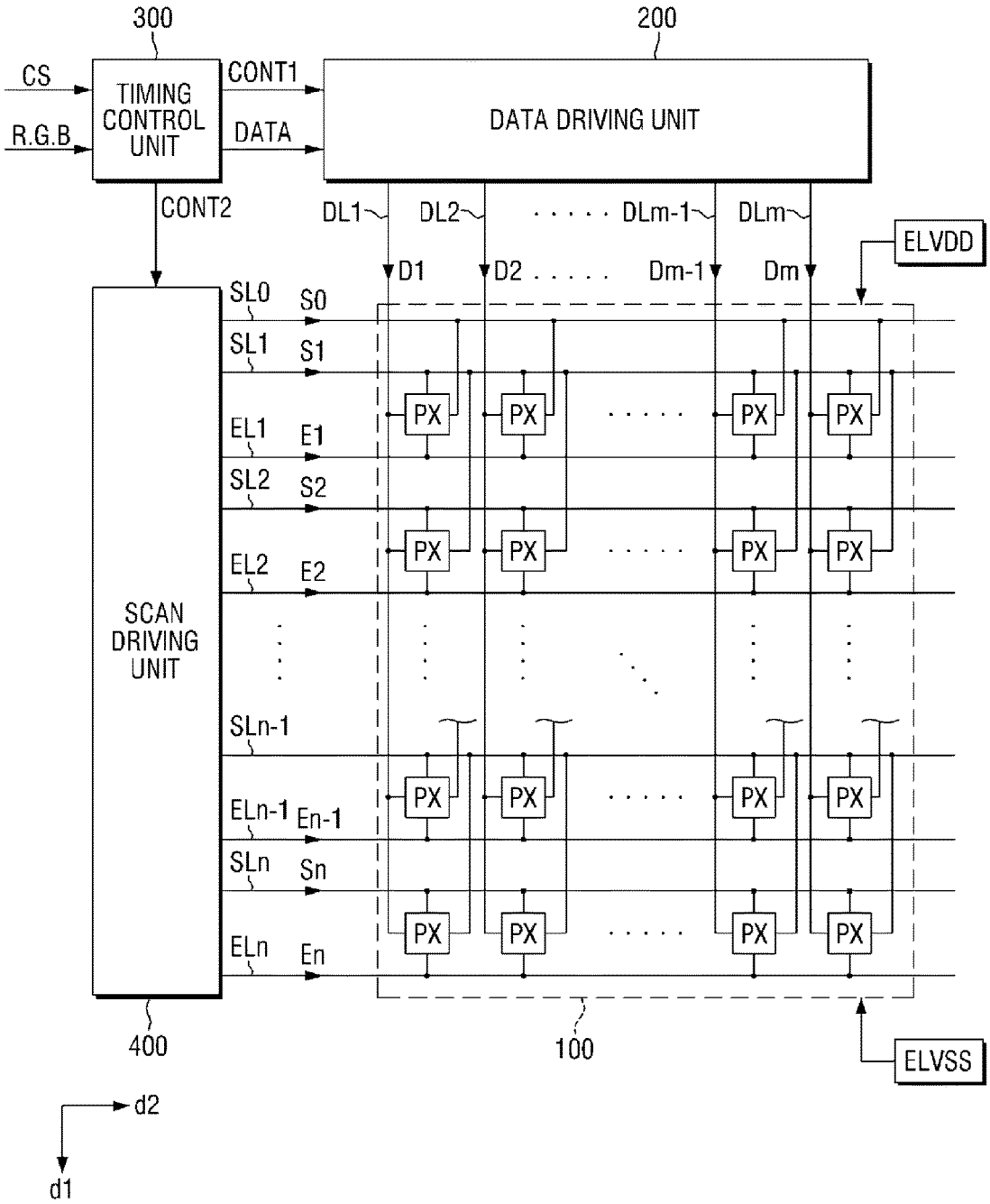
FIG. 1 is a block diagram of an organic light emitting display according to one or more exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Exemplary embodiments compensate for a difference between degrees of voltage drop that is generated between driving voltages of respective pixel units and deviation of threshold voltages of driving transistors in respective pixel units.

Use of a sustain voltage allows for compensation of a difference between the a relative degree of voltage drop of the driving voltages supplied to the respective pixel units, and thus the luminance non-uniformity that is caused by the positions of the pixel units in the display panel can be remedied.

Further, even in the case where the threshold voltages and the driving voltages of the driving transistors are different from each other for the respective pixels, the luminance non-uniformity between the pixel units can be remedied through compensation for the threshold voltages of the driving transistors. Further, through compensation for the threshold voltages of the driving transistors, LRU (Long Range Uniformity) can be prevented from being affected.

FIG. 1 is a block diagram of an organic light emitting display according to one or more exemplary embodiments.

Referring to FIG. 1, an organic light emitting display includes display panel 100, data driving unit 200, timing control unit 300, scan driving unit 400, and a power supply unit (not illustrated).

Display panel 100 may be a region where an image is displayed. Display panel 100 may include a plurality of data lines DL1 to DLm (where, m is a natural number that is larger than "1"), a plurality of scan lines SL1 to SLn that cross the plurality of data lines DL1 to DLm, and a plurality of emission control lines EL1 to ELn (where, n is a natural number that is larger than "1"). Further, display panel 100 may include a plurality of pixel units PX arranged in a region where the plurality of data lines DL1 to DLm, the plurality of scan lines SL1 to SLn, and the plurality of emission control lines EL1 to ELn cross each other. In an embodiment, the plurality of the pixel units may be arranged in the form of a matrix. The plurality of data lines DL1 to DLm may extend in a first direction d1, and the plurality of scan lines SL1 to SLn and the plurality of emission control lines EL1 to ELn may extend in a second direction d2 that crosses the first direction d1. Referring to FIG. 1, the first direction d1 may be a column direction, and the second direction d2 may be a row direction.

Each of the plurality of pixel units PX may be connected to one of the plurality of data lines DL1 to DLm, one of the plurality of scan lines SL1 to SLn, and one of the plurality of emission control lines EL1 to ELn. Further, one of the plurality of pixel units PX, which is connected to the i-th (where, i is a natural number that is equal to or larger than "2") scan line SLi may also be connected to the (i−1)-th scan line SLi−1 among the plurality of scan lines SL1 to SLn. This will be described in detail with reference to FIG. 2. On the other hand, one of the plurality of pixel units PX, which is connected to the first scan line SL1, may also be connected to the 0-th scan line SL0. In this case, the 0-th scan line SL0 may be a dummy scan line.

The plurality of pixel units PX may receive a plurality of scan signals S1 to Sn from the plurality of scan lines SLi to SLn, a plurality of data signals DL1 to DLm from the plurality of data lines Sl1 to DLn, and a plurality of emission control signals E1 to En from the plurality of emission control lines EL1 to ELn. On the other hand, each of the plurality of pixel units PX may be connected to a first power terminal ELVDD through a first power line, and may be connected to a second power terminal EVLSS through a second power line. Further, each of the plurality of pixel units PX may be connected to a sustain power terminal (Vsus in FIG. 2). The power supply unit may include the first power terminal, the second power terminal, and the sustain power terminal. Each of the plurality of pixel units PX may control an amount of current that flows from the first power terminal ELVDD to the second power terminal ELVSS in correspondence to the data signals D1 to Dm that are provided from the first power terminal and the plurality of data lines DL1 to DLm. Hereinafter, the first power terminal and the first driving voltage that is provided from the first power terminal are all denoted by ELVDD, the second power terminal and the second driving voltage that is provided from the second power terminal are all denoted by ELVSS and the sustain power terminal and the sustain voltage that is provided from the sustain power terminal are all denoted by Vsus.

Data driving unit 200 may be connected to display panel 100 through the plurality of data lines DL1 to DLm. Data driving unit 200 may provide the data signals D1 to Dm to the data lines DL1 to DLm according to a control signal CONT1 that is provided from the timing control unit 300. Switching transistors MS (see FIG. 2) in the plurality of pixels may be turned on by the low-level scan signals. The organic light emitting diodes OLED in the plurality of pixel units PX emit light in correspondence to the received data signals to display a video image.

Timing control unit 300 may receive a control signal CS and video signals R, G, and B from an external system. The control signal CS may include a vertical sync signal Vsync and a horizontal sync signal Hsync. The video signals R, G, and B include luminance information of the plurality of pixel units PX. The luminance may have 1024, 256, or 64 gray levels. Timing control unit 300 may divide the video signals R, G, and B in the unit of a frame according to the vertical sync signal Vsync, and may divide the video signals R, G, and B in the unit of a scan line according to the horizontal sync signal Hsync to generate video data DATA. Timing control unit 300 may provide control signals CONT1 and CONT2 to data driving unit 200 and scan driving unit 400 according to the control signal CS and the video signals R, G, and B. Timing control unit 300 may provide the video data DATA to data driving unit 200 together with the control signal CONT1, and data driving unit 200 may generate the plurality of data signals D1 to Dm through sampling and holding of the input video data DATA according to the control signal CONT1 and converting of the video data into an analog voltage.

Scan driving unit 400 may be connected to display panel 100 through the plurality of scan lines SL1 to SLn and the plurality of control lines EL1 to ELn. Scan driving unit 400 may sequentially apply the plurality of scan signals S1 to Sn to the plurality of scan lines SL1 to SLn according to the control signal CONT2 provided from timing control unit 300. Further, scan driving unit 400 may provide the plurality of emission control signals E1 to En to the plurality of pixel units PX through the plurality of emission control lines EL1 to ELn. In this case, the first data line DL1 and the first emission control line EL1 may be connected to the pixel units in the same column group. In this example, scan driving unit 400 provides the plurality of emission control signals E1 to En to the plurality of pixel units PX, but the configuration is not limited thereto. The plurality of emission control signals E1 to En may be provided through a separate integrated circuit IC and the emission control lines EL1 to ELn connected thereto.

The power supply unit (not illustrated) may provide driving voltages to the plurality of pixel units PX according to the control signal provided from timing control unit 300. The first and second power terminals ELVDD and ELVSS may provide driving voltages required for the operation of the plurality of pixel units PX. The power supply unit (not illustrated) may also provide the sustain voltage Vsus to the plurality of pixel units PX. Unlike the power line that is connected to the first power terminal, the power line that provides the sustain voltage Vsus may not form a current path across each pixel unit. That is, the sustain power terminal may supply a predetermined voltage (e.g. low level voltage) to the specific node (e.g. N1, N4 in FIG. 2) in a pixel without forming a current path to other pixels, and the power line that provides the sustain voltage Vsus may be arranged to be in parallel to the direction in which the plurality of data lines DL1 to DLm are arranged and to cross the direction in which the plurality of scan lines SL1 to SLn are arranged. Accordingly, the sustain voltage Vsus (see FIG. 2) may be independently provided to the respective pixel units which are positioned in the rows that are selected by the plurality of scan signals S1 to Sn provided from the plurality of scan lines SL1 to SLn.

Figure 2:
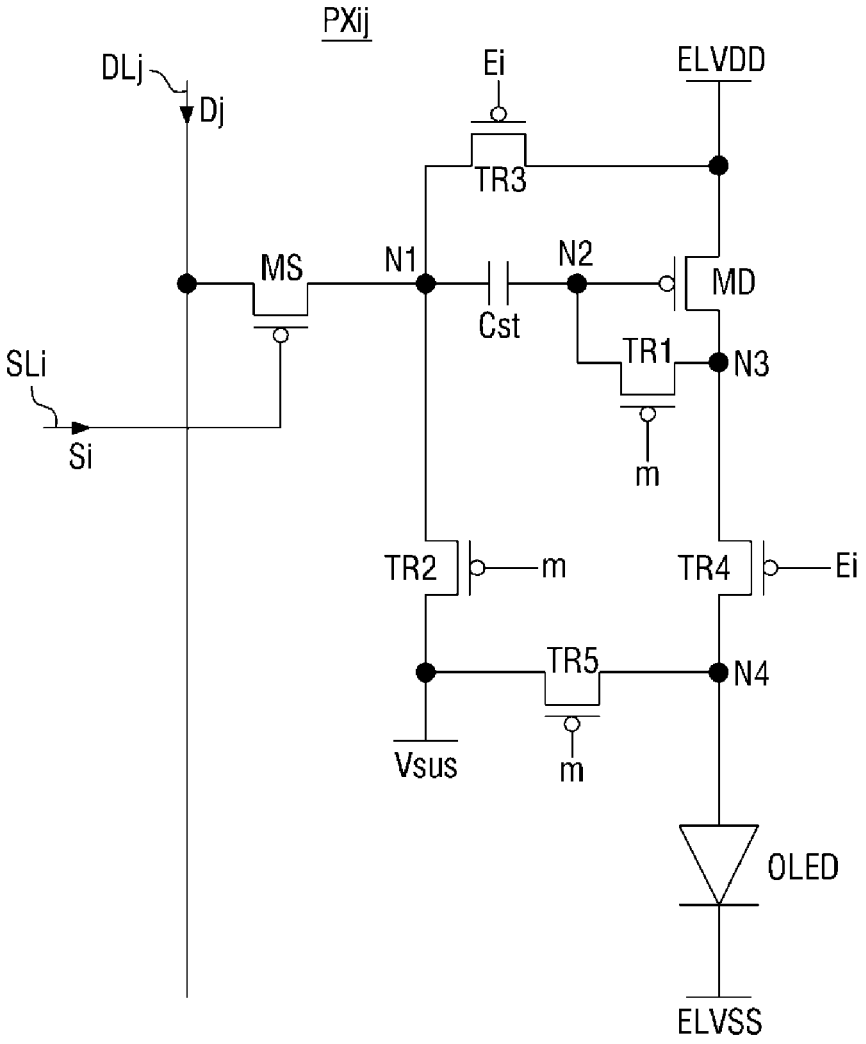
FIG. 2 is a circuit diagram of a pixel unit included in the configuration of the organic light emitting display illustrated in FIG. 1.

FIG. 2 is a circuit diagram of a pixel unit PXij included in the configuration of the organic light emitting display illustrated in FIG. 1. Specifically, FIG. 2 is a circuit diagram exemplarily illustrating a pixel unit PXij that is connected to the i-th (where, i is a natural number) scan line SLi, the j-th data line DLj, and the i-th control line ELi. Other pixel units may have the same structure. However, the circuit construction of FIG. 2 is exemplary, and the circuit of the pixel unit PXij according to this embodiment is not limited thereto.

Referring to FIG. 2, a pixel unit PXij according to one or more exemplary embodiments may include a switching transistor MS, a driving transistor MD, first to fifth transistor TR1 to TR5, a storage capacitor Cst, and an organic light emitting diode OLED.

The switching transistor MS may include an electrode connected to the j-th data line Dj, another electrode connected to a first node N1, and a gate electrode connected to the i-th scan line SLi. The switching transistor MS may be turned on by the i-th scan signal SLi (of, e.g. a low level) that is applied to the i-th scan line SLi to provide the j-th data signal Dj that is provided through the j-th data line DLj to the first node N1. The switching transistor MS may be a p-channel field effect transistor. Thus, the switching transistor MS may be turned on by a scan signal of a low level, and may be turned off by a scan signal of a high level. Here, the driving transistor MD and the first to fifth transistors TR1 to TR5 may all be p-channel field effect transistors, but some or all of the switching transistor MS, the driving transistor MD, and the first to fifth transistors TR1 to TR5 may be n-channel field effect transistors.

The driving transistor MD may include an electrode connected to the first power terminal ELVDD, another electrode connected to a third node N3, and a gate electrode connected to a second node N2. The driving transistor MD may control an amount of current that is provided from the first power terminal ELVDD to the second power terminal ELVSS through the organic light emitting diode OLED according to the voltage that is applied to the second node N2.

The first transistor TR1 may include an electrode connected to the second node N2 and another electrode connected to the third node N3, and may receive a first control signal m through a gate electrode thereof. The gate electrode of the first transistor TR1 may be connected to the (i−1)-th scan line SLi−1. Accordingly, the first control signal m may be the (i−1)-th scan signal Si−1 that is provided from the (i−1)-th scan line SLi−1. Hereinafter, the (i−1)-th scan signal Si−1 is denoted as the first control signal m, and the (i−1)-th scan signal line is denoted as the first control signal line. The first transistor TR1 may be turned on according to the first control signal m of a low level to connect the driving transistor MD in the form of a diode.

The second transistor TR2 may include an electrode connected to the first node N2 and another electrode connected to the power terminal supplying the sustain voltage Vsus, and may receive the first control signal m through a gate electrode thereof. The gate electrode of the second transistor TR2 may receive the first control signal m through the (i−1)-th scan line SLi−1. The second transistor TR2 may apply the sustain voltage Vsus to the first node N1 according to the first control signal m of a low level. Here, the first driving voltage ELVDD may be a high level voltage, and the second driving voltage ELVSS and the sustain voltage Vsus may be low level voltages.

The third transistor TR3 may include one electrode connected to the first node N2, the other electrode connected to the first power terminal ELVDD, and a gate electrode connected to the i-th emission control line ELi. The second control signal Ei may be a signal that is provided from the i-th emission control line ELi. The third transistor TR3 may apply the first driving voltage ELVDD to the first node N1 according to the emission control signal Ei of a low level that is provided through the gate electrode.

The fourth transistor TR4 may include an electrode connected to the third node N3, another electrode connected to a fourth node N4, and a gate electrode connected to the i-th emission control line ELi. The emission control signal Ei may be a signal that is provided from the i-th emission control line ELi. The fourth transistor TR4 may connect a signal path between the third node N3 and the fourth node N4 according to the emission control signal Ei of a low level that is provided through the gate electrode. Further, the fourth transistor may prevent driving current from flowing to the organic light emitting diode OLED according to the emission control signal Ei of a high level that is provided through the gate electrode.

The fifth transistor TR5 may include an electrode connected to the power terminal supplying the sustain voltage terminal Vsus and another electrode connected to the fourth node N4 and may receive the first control signal m through a gate electrode thereof. The gate electrode of the fifth transistor TR5 may be connected to the (i−1)-th scan line SLi−1. The fifth transistor TR5 may apply the sustain voltage Vsus to the fourth node N4 according to the first control signal m of a low level.

According to the organic light emitting display according to one or more exemplary embodiments, the first control signal m may be provided to the first, second, and fifth transistors TR1, TR2, and TR5, and the emission control signal Ei may be provided to the third and fourth transistors TR3 and TR4. However, in the case where the first, second, and fifth transistors TR1, TR2, and TR5 and the third and fourth transistors TR3 and TR4 are implemented by transistors having different types of channels (e.g. p type and n type), the first to fifth transistors TR1 to TR5 can all be controlled by a single control signal.

The storage capacitor Cst may include one end connected to the first node N1 and the other end connected to the second node N2. The storage capacitor Cst may be charged with a difference voltage between the first and second nodes N1 and N2.

The organic light emitting diode OLED may include an anode electrode connected to the fourth node N4, a cathode electrode connected to the second power terminal ELVSS, and an organic light emitting layer. The organic light emitting layer may emit light having one of primary colors, and the primary colors may be three primary colors of red, green, and blue. A desired color may be displayed through a spatial sum or temporal sum of the three primary colors. The organic light emitting layer may include low-molecular organic materials or high-molecular organic materials that correspond to the respective colors. In accordance with an amount of current that flows through the organic light emitting layer, the organic materials that correspond to the respective colors may emit light accordingly.

Figure 3:
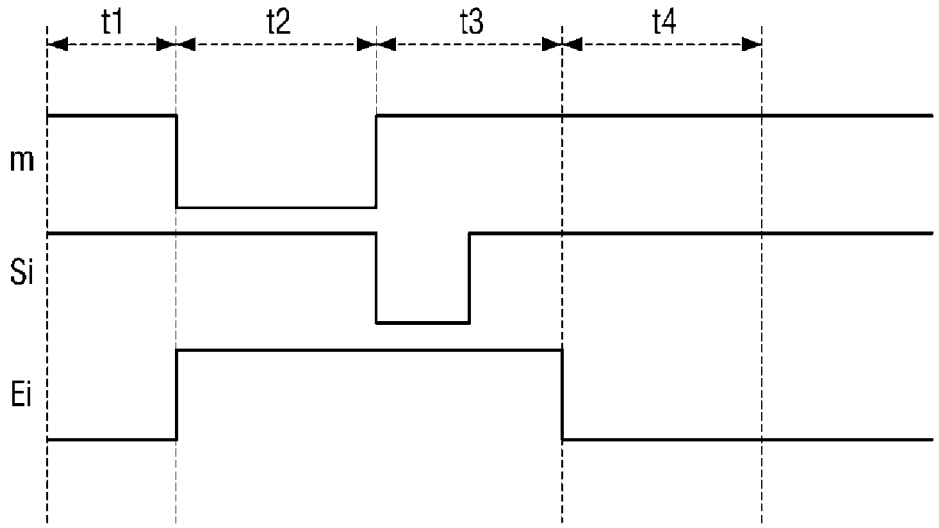
FIG. 3 is a timing diagram explaining a method for driving an organic light emitting display illustrated in FIG. 1.

FIG. 3 is a timing diagram explaining a method for driving an organic light emitting display illustrated in FIG. 1. FIGS. 4 to 7 are circuit diagrams explaining the operation of the pixel unit PXij illustrated in FIG. 2 in first to fourth periods of the timing diagram illustrated in FIG. 3. The organic light emitting display according to one ore more exemplary embodiments may compensate for the threshold voltage Vth of the driving transistor MD through performing compensation driving in a compensation period. In this case, the compensation period may include first to fourth periods t1 to t4.

Figure 4:
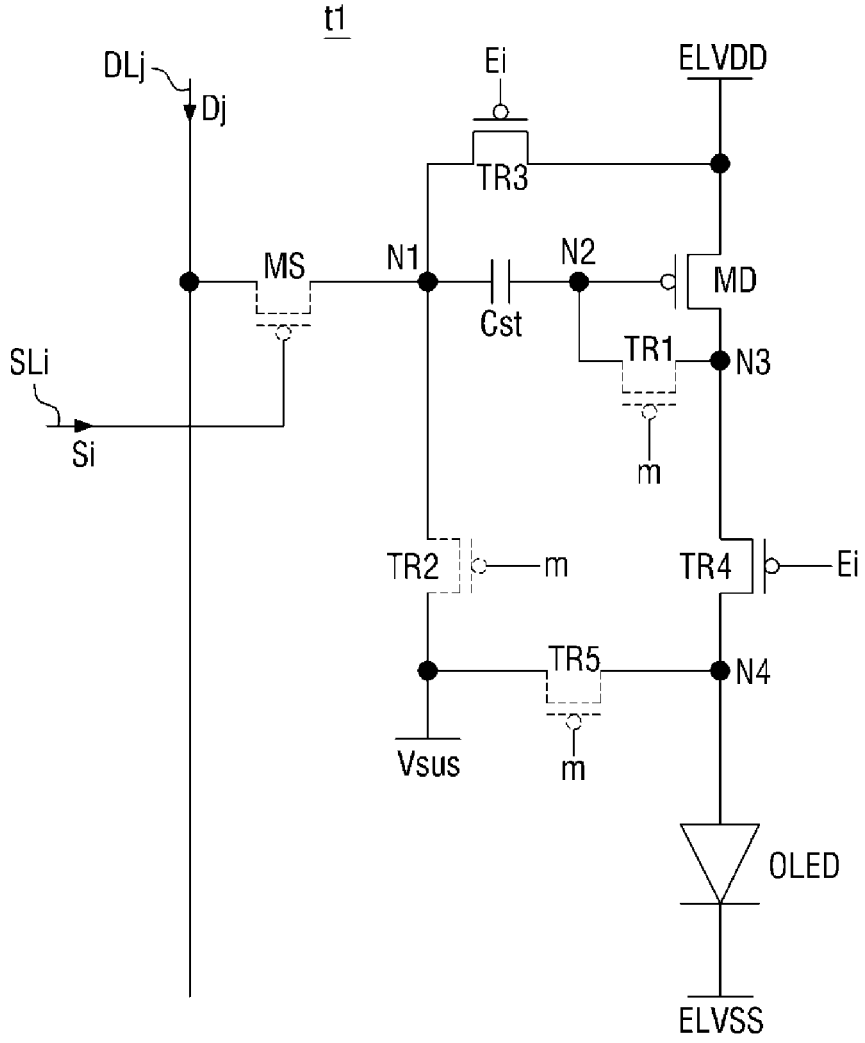
FIGS. 4, 5, 6, and 7 are circuit diagrams explaining the operation of the pixel unit illustrated in FIG. 2 in first to fourth periods of the timing diagram illustrated in FIG. 3.

First, referring to FIGS. 3 and 4, in the first period t1, the third and fourth transistors TR3 and TR4 may be turned on according to the emission control signal Ei of a low level that is provided through the i-th emission control line EL. The switching transistor MS may receive the i-th scan signal Si of a high level to sustain its turn-off state. The first, second, and fifth transistors TR1, TR2, and TR5 may receive the first control signal m of a high level to sustain the turn-off state. If the third transistor TR3 is turned on, the signal path between the first node N1 and the first power terminal ELVDD is connected, and thus the driving voltage may be applied to the first node N1. The voltage of the first node N1 may be initialized as the first driving voltage ELVDD since the third transistor TR3 sustains the turn-on state during the first period t1. On the other hand, if the fourth transistor TR4 is turned on, the third node N3 and the anode electrode of the organic light emitting diode OLED are connected with each other, the organic light emitting diode OLED may emit light. In this case, the organic light emitting diode OLED may emit light to correspond to the voltage that is stored at the storage capacitor Cst based on the data value applied to the first node N1 in the previous frame.

Figure 5:
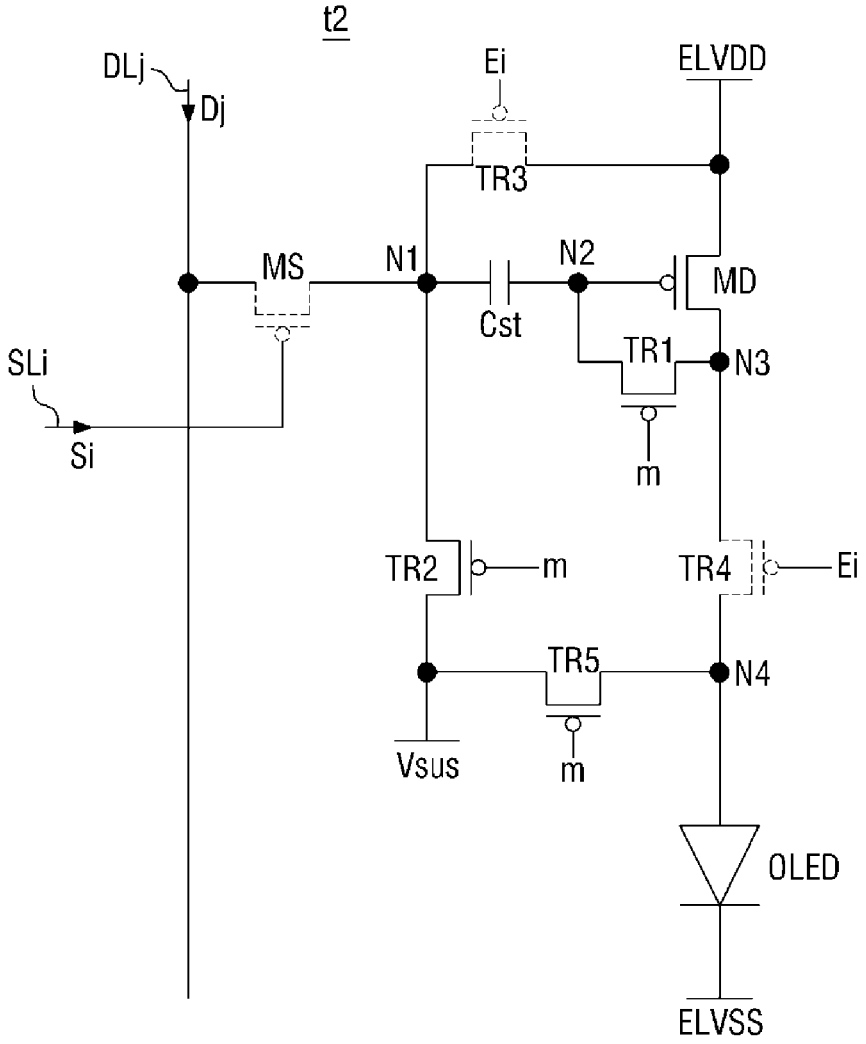

Referring to FIGS. 3 and 5, in the second period t2, the first, second, and fifth transistors TR1, TR2, and TR5 may receive the first control signal m of a low level to be switched to a turn-on state. The third and fourth transistors TR3 and TR4 may receive the emission control signal Ei of a high level to be switched to a turn-off state. The switching transistor MS may receive the i-th scan signal Si of a high level to sustain the turn-off state. If the first transistor TR1 is turned on, the driving transistor MD may be connected in the form of a diode. Accordingly, the threshold voltage Vth of the driving transistor MD may be applied between the gate electrode and an electrode (source electrode) of the driving transistor MD. In this case, since the electrode (source electrode) of the driving transistor MD is connected to the first power terminal ELVDD, a voltage that corresponds to the sum of the driving voltage ELVDD and the threshold voltage Vth of the driving transistor MD may be applied to the gate electrode of the driving transistor MD, i.e., the second node N2. Accordingly, the voltage that is applied to the second node N2 may be expressed as in Equation 1 below.

$$Vn2=ELVDD+Vth \quad \text{[Equation 1]}$$

Here, Vn1 denotes a voltage that is applied to the first node N1, and consequently a voltage that is applied to the other terminal of the storage capacitor Cst. On the other hand, if the second transistor T2 is turned on, the sustain voltage Vsus may be applied to the first node N1. Accordingly, the voltage of the first node N1 may be changed from the first driving voltage ELVDD that is provided in the first period t1 to the sustain voltage Vsus. Accordingly, the change amount ΔVn1 of the voltage that is applied to the first node N1 may be expressed as in Equation 2 below.

$$\Delta Vn1=Vsus-ELVDD \quad \text{[Equation 2]}$$

Further, if the fifth transistor TR5 is turned on, the sustain voltage Vsus may be applied to the fourth node N4. Accordingly, the voltage of the fourth node N4 may be initialized as the sustain voltage Vsus since the fifth transistor TR5 sustains the turn-on state during the second period t2. On the other hand, the width of the second period t2 may be set to be wide enough to have a sufficient compensation period of the threshold voltage Vth through adjustment of the width of the first control signal m. In an embodiment, the turn-on time of the first, second, and fifth transistors TR1, TR2, and TR5 that are turned on in the second period t2 may be longer than the turn-on time of the switching transistor MS that is turned on in the third period t3.

Figure 6:
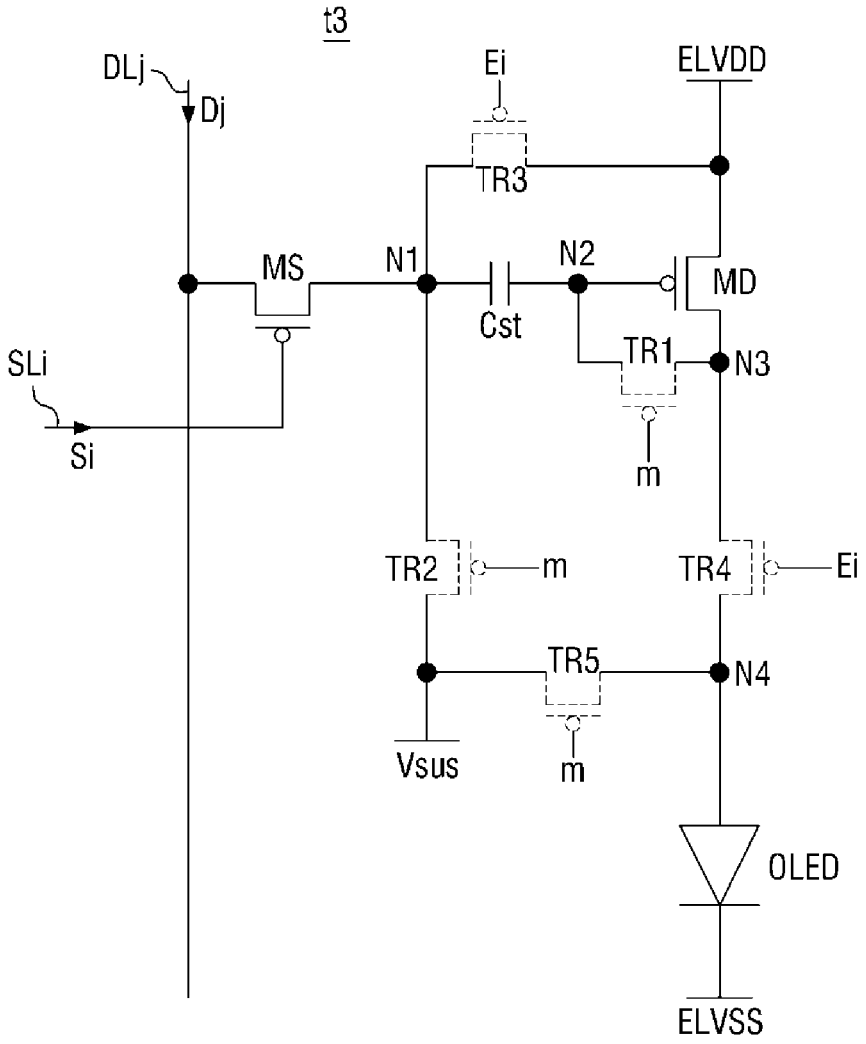
Figure 7:
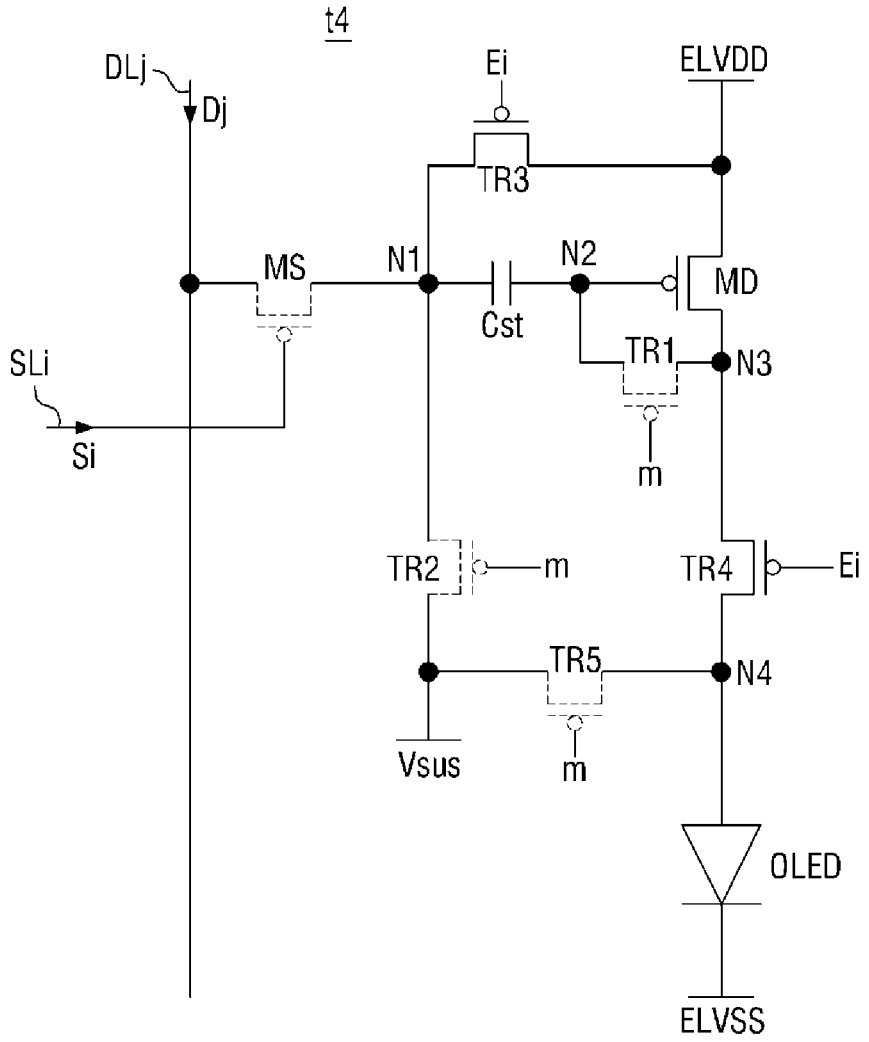

Referring to FIGS. 3, 6, and 7, the switching transistor MS may receive the i-th scan signal Si of a low level to be switched to a turn-on state in the third period t3, whereas the switching transistor MS may receive the i-th scan signal Si of a high level to be switched to a turn-off state in the fourth period t4. The third and fourth transistors TR3 and TR4 may receive the emission control signal Ei of a high level to sustain the turn-off state in the third period t3, whereas the third and fourth transistors TR3 and TR4 may receive the emission control signal Ei of a low level to be switched to the turn-on state in the fourth period t4. The first, second, and fifth transistors TR1, TR2, and TR5 may receive the first control signal m of a high level to be switched to the turn-off state in the third period t3, whereas the first, second, and fifth transistors TR1, TR2, and TR5 may sustain the turn-off state in the fourth period t4. If the switching transistor MS is turned on in the third period t3, a voltage that corresponds to the j-th data signal Dj that is provided from the j-th data line DLj may be applied to the first node N1. Thereafter, as the third transistor TR3 is turned on and the switching transistor MS is turned off in the fourth period t4, the first driving voltage ELVDD may be applied to the first node N1. In this case, the voltage of the second node N2, i.e., the voltage at the other terminal of the storage capacitor Cst, is increased as high as the voltage of the first node N1, i.e., as high as the change amount of the voltage at one terminal of the storage capacitor Cst. The voltage that is applied to the second node N2 may be expressed as in Equation 3 below.

$$Vn2=ELVDD+Vth+\Delta Vn1 \quad \text{[Equation 3]}$$

Further, the change amount ΔVn1 of the voltage at the first node N1 may be expressed as in Equation 4 below.

$$\Delta Vn1=ELVDD-(Vdata-(Vsus-ELVDD))=Vsus-Vdata \quad \text{[Equation 4]}$$

In this case, Vdata denotes a voltage that corresponds to the j-th data signal Dj that is provided through the j-th data line DLj. Further, since the fourth transistor TR4 is turned on in the fourth period t4, the driving current that flows through the driving transistor MD may be applied to the organic light emitting diode OLED. The organic light emitting diode OLED may emit light according to the provided driving current. As a result, the voltage Vn2 that is applied to the second node N2 may include a compensation voltage that is required to compensate for the threshold voltage Vth of the driving transistor MD, and the fourth period t4 may be a light emitting period. The driving current $I_{OLED}$ that flows through the organic light emitting diode OLED may be expressed as in Equation 5 below.

$$I_{OLED} = \frac{\beta}{2}(Vgs - Vth)^2 = \frac{\beta}{2}(((ELVDD + Vth + \Delta Vn1) - ELVDD) - Vth)^2 = \frac{\beta}{2}(\Delta Vn1)^2 = \frac{\beta}{2}(Vsus - Vdata)^2 \quad \text{[Equation 5]}$$

Here, β denotes a constant value that is determined by mobility and parasitic capacitance of the driving transistor MD. Further, Vgs denotes a voltage between the gate electrode and the one electrode (source electrode) of the driving transistor MD, and $I_{OLED}$ denotes the driving current that flows through the organic light emitting diode OLED. As can be known from Equation 5, the driving current $I_{OLED}$ that flows through the organic light emitting diode OLED is not affected by the threshold voltage Vth of the driving transistor MD, and thus the deviation of the threshold voltage Vth of the driving transistor MD existing in each of the plurality of pixel units PX. Further, according to the organic light emitting display according to one or more exemplary embodiments, since the deviation of the threshold voltage Vth of the driving transistor MD is compensated for, the opening rate of the pixel units can be increased, and the luminance non-uniformity between the plurality of pixel units can be solved. Since the driving current $I_{OLED}$ that flows through the organic light emitting diode OLED as in Equation 5 may be set regardless of the driving voltage ELVDD that is provided from the first power terminal ELVDD, an image having a desired luminance can be displayed regardless of the voltage drop of the first power terminal ELVDD. Further, referring to Equation 5, even in the case where the driving current $I_{OLED}$ that flows through the organic light emitting diode OLED is not affected by the sustain voltage Vsus, the current path through the sustain power line is not formed in the pixel unit PXij, and thus the voltage drop does not occur on the power line that supplies the sustain voltage Vsus. As a result, according to the organic light emitting display according to one or more exemplary embodiments, substantially the same sustain voltage Vsus can be applied to the plurality of pixel units PX, and thus it is possible to make desired driving current $I_{OLED}$ flow through the organic light emitting diode OLED.

Figure 8:
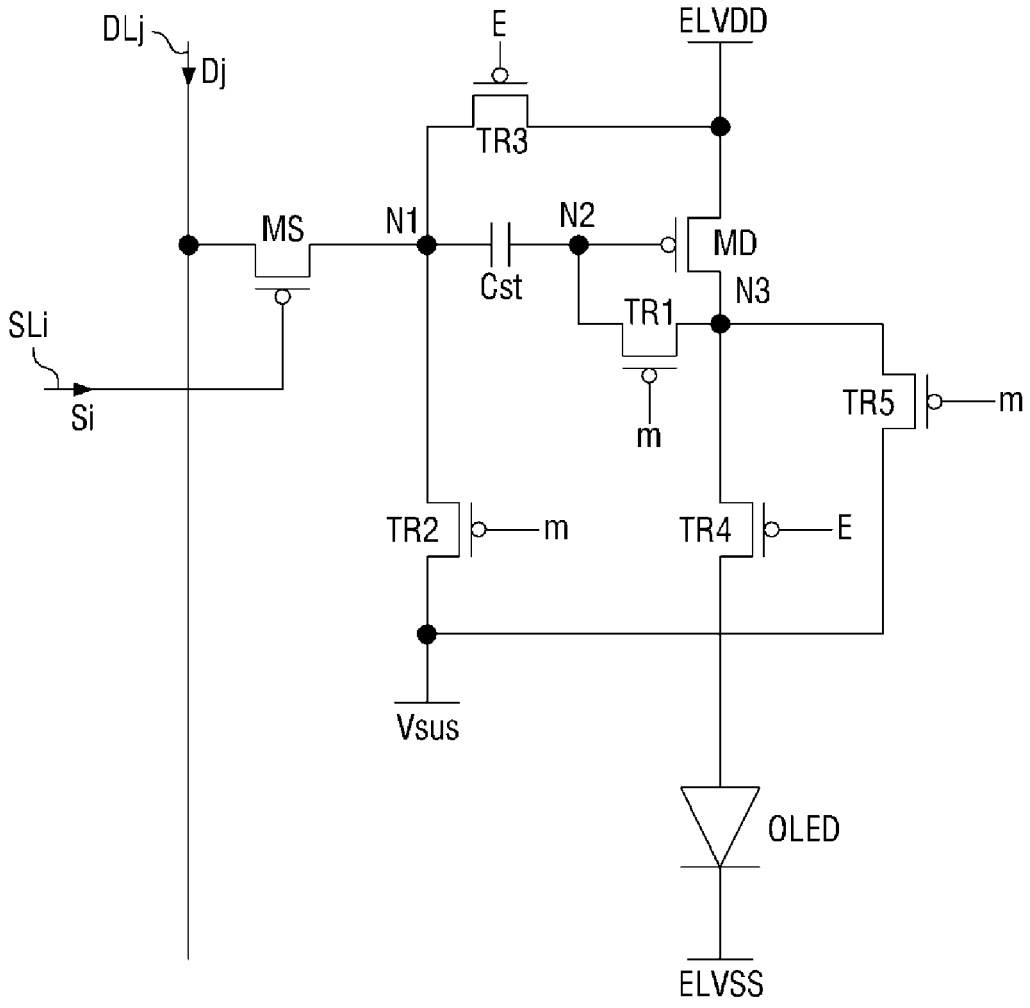
FIG. 8 is a circuit diagram of a pixel unit included in the configuration of the organic light emitting display illustrated in FIG. 1 according to one or more exemplary embodiments.

FIG. 8 is a circuit diagram of a pixel unit PXij included in the configuration of the organic light emitting display illustrated in FIG. 1 according to one ore more exemplary embodiments. Hereinafter, the second exemplary embodiment in FIG. 8 is described focusing on differences from the first exemplary embodiment in FIG. 2. Like reference numerals denote like elements. Referring to FIGS. 3 and 8, the fifth transistor TR5 may include an electrode connected to the sustain power terminal supplying the sustain voltage Vsus and another electrode connected to the third node N3, and may receive the first control signal m through the gate electrode thereof. That is, the fifth transistor TR5 may be turned on according to the first control signal m of a low level in the second period t2 to apply the sustain voltage Vsus to the third node N3. Accordingly, the voltage of the third node N3 may be initialized as the sustain voltage Vsus since the fifth transistor TR5 sustains the turn-on state in the second period t2.

Figure 9:
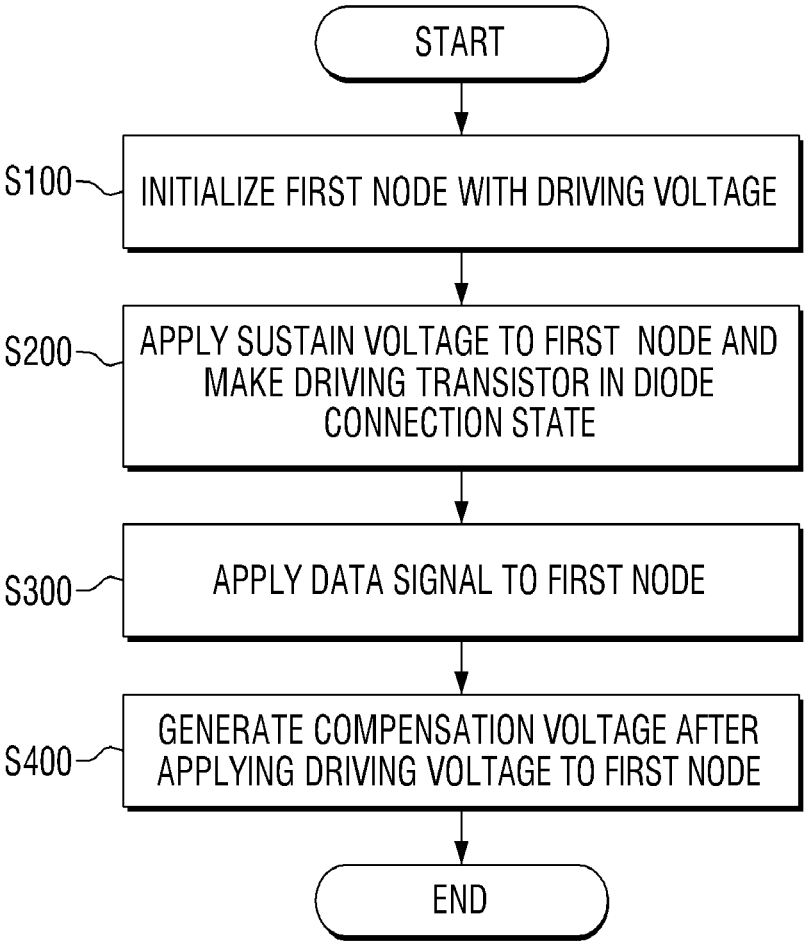
FIG. 9 is a flowchart illustrating a method for driving an organic light emitting display according to one or more exemplary embodiments.

FIG. 9 is a flowchart illustrating a method for driving an organic light emitting display according to one or more exemplary embodiments.

Referring to FIGS. 1, 2, and 9, according to a method for driving an organic light emitting display according to one or more exemplary embodiments, a first node N1 may be initialized as a first driving voltage ELVDD that is proved from a first power terminal ELVDD in a first period t1 (S100). In a second period t2, a sustain voltage Vsus may be applied to the first node N1, and in a third period t3, a first transistor TR1 may be turned on to make a driving transistor MD in a diode connection state (S200). In a third period t3, a switching transistor MS may be turned on to make a voltage that corresponds to the j-th data signal Dj be applied to the first node N1 (S300). Thereafter, in a fourth period t4, a third transistor TR3 may be turned on, and thus the first driving voltage ELVDD may be applied again to the first node N1 (S400). Accordingly, the voltage of a second node N2 may be increased as much as the voltage change amount ΔVn1 of the first node N1, and as a result, a driving current $I_{OLED}$ that flows through an organic light emitting diode OLED may be expressed as in Equation 5 as described above.

That is, the driving current $I_{OLED}$ that flows through an organic light emitting diode OLED may not be affected by threshold voltages Vth of the driving transistor MD, and may be set regardless of the first driving voltage ELVDD that is provided from the first power terminal ELVDD. Accordingly, the organic light emitting display according to one or more exemplary embodiments can reduce luminance non-uniformity between a plurality of pixel units PX and voltage drop phenomenon of the first power terminal.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light emitting display comprising:

data lines;

scan lines;

a pixel unit corresponding to the data lines and the scan lines; and a power supply unit comprising a first power terminal configured to supply a first driving voltage, a second power terminal configured to supply a second driving voltage, and a sustain power terminal configured to supply a sustain voltage to the pixel unit, wherein the pixel unit comprises:

a switching transistor comprising a gate electrode receiving a scan signal, an electrode connected to a data line, and another electrode connected to a first node, a storage capacitor comprising a terminal connected to the first node and another terminal connected to a second node, a driving transistor comprising a gate electrode connected to the second node, an electrode connected to the first power terminal, and another electrode connected to an organic light emitting diode through a third node, a first transistor comprising a gate electrode receiving a first control signal, an electrode connected to the second node, and another electrode connected to the third node, a second transistor comprising an electrode connected to the first node and another electrode connected to the sustain power terminal, and a third transistor comprising an electrode coupled to the first node and another electrode coupled to the first power terminal, wherein the gate electrode of the first transistor receives the first control signal in a first time period and the gate electrode of the switching transistor receives the scan signal in a second time period subsequent to the first period.

2. The organic light emitting display of claim 1, further comprising a control unit configured to turn on the switching, first, and second transistors, wherein the first and second transistors are turned on for a longer period than a period when the switching transistor is turned on.

3. The organic light emitting display of claim 1, wherein the pixel unit further comprises a fourth transistor comprising an electrode connected to the third node and another electrode connected to an anode electrode of the organic light emitting diode.

4. The organic light emitting display of claim 3, further comprising a control unit configured to turn on the third transistor substantially simultaneously with the fourth transistor.

5. The organic light emitting display of claim 1, wherein the second transistor further comprises a gate electrode receiving the first control signal, and the pixel unit further comprises a fifth transistor comprising a gate electrode receiving the first control signal, an electrode connected to the sustain voltage terminal, and another electrode connected to at least one of an anode electrode of the organic light emitting diode and the third node.

6. The organic light emitting display of claim 5, further comprising a control unit configured to turn on the fifth transistor substantially simultaneously with the first and second transistors.

7. An organic light emitting display comprising:

data lines;

scan lines;

a pixel unit corresponding to the data lines and the scan lines; and a power supply unit comprising a first power terminal configured to supply a first driving voltage, a second power terminal configured to supply a second driving voltage, and a sustain power terminal configured to supply a sustain voltage to the pixel unit, wherein the pixel unit comprises:

a switching transistor configured to apply a data signal to a first node according to a scan signal, a storage capacitor, connected between the first node and a second node, configured to be charged with a difference voltage of voltages applied to the first and second nodes, a driving transistor configured to control an amount of current provided from the first power terminal to an organic light emitting diode according to voltage applied to the second node, a first transistor configured to provide a signal path between the second node and a third node coupled to an electrode of the driving transistor based on a first control signal, a second transistor configured to apply a sustain voltage to the first node based on the first control signal, and a third transistor configured to apply a driving voltage provided from the first power terminal to the first node according to a second control signal, wherein the first transistor receives the first control signal in a first time period and the switching transistor receives the scan signal in a second time period subsequent to the first period.

8. The organic light emitting display of claim 7, further comprising a control unit configured to turn on the first and second transistors for a longer period than a period when the switching transistor is turned on.

9. The organic light emitting display of claim 7, wherein the pixel unit further comprises a fourth transistor configured to connect the third node and the organic light emitting diode based on the second control signal.

10. The organic light emitting display of claim 7, wherein the pixel unit further comprises a fifth transistor configured to apply the sustain voltage to at least one of the organic light emitting diode and the third node based on the first control signal.

11. The organic light emitting display of claim 7, further comprising a scan driving unit configured to provide the scan signal to the display panel through an i-th scan line (where, i is a natural number), wherein the first control signal is an (i−1)-th scan signal applied through an (i−1)-th scan line.

12. The organic light emitting display of claim 7, further comprising a control unit configured to turn on the third transistor in a first period to apply the first driving voltage to the first node, to turn on the second transistor on in a second period that is subsequent to the first period to apply the sustain voltage to the first node, to turn on the switching transistor in a third period that is subsequent to the second period to apply a voltage that corresponds to the data signal to the first node, wherein the first driving voltage is applied to the first node in a fourth period that is subsequent to the third period.

13. The organic light emitting display of claim 12, wherein the control unit is configured to turn the first transistor on in the second period to place the driving transistor in a diode-connected state.

14. The organic light emitting display of claim 13, wherein the control unit is configured to turn off the third transistor in the second and third periods to break a signal path between the first node and the first power terminal.

15. A method for driving an organic light emitting display, comprising:

initializing a first node of a storage capacitor, connected between the first node and a second node, with a first driving voltage that is provided from a first power terminal;

applying a sustain voltage from a second power terminal different from the first power terminal to the first node in response to a control signal applied to a gate electrode of a sustain voltage transistor disposed between a sustain voltage terminal and the first node and placing a driving transistor in a diode connection state, wherein the driving transistor comprises a gate electrode connected to the second node, an electrode connected to the first power terminal, and another electrode connected to an organic light emitting diode through a third node;

applying a data signal, provided from the data line through a switching transistor comprising a gate electrode connected to a scan line, an electrode connected to the data line, and another electrode connected to a first node, to the first node; and generating a compensation voltage by applying the first driving voltage to the first node.

16. The method of claim 15, wherein the step of applying the sustain voltage comprises using a first transistor having a gate electrode receiving the first control signal, an electrode connected to the second node and another electrode connected to an electrode of the driving transistor and a second transistor-comprising the sustain voltage transistor, and wherein the step of initializing the first node comprises using a third transistor having an electrode connected to the first node and another electrode connected to the first power terminal.

17. The method of claim 16, further comprising:

turning on the first and second transistors for a period that is longer than a period when the switching transistor is turned on.

18. The method of claim 16, wherein the step of applying the sustain voltage to the first node and placing a driving transistor in a diode connection state comprises applying a sum of a threshold voltage of the driving transistor and the driving voltage to the second node during a period when the first transistor is turned on.

19. The method of claim 16, further comprising:

providing a current path to an organic light emitting element using a fourth transistor comprising an electrode connected to an electrode of the driving transistor and another electrode connected to the organic light emitting element; and initializing the organic light emitting element using a fifth transistor comprising an electrode connected to the sustain voltage terminal and another electrode connected to an electrode of the fourth transistor.

20. The method of claim 19, further comprising applying different signals to gate electrodes of the first, second, and fifth transistors than signals applied to gate electrode of the third and fourth transistors.

21. An organic light emitting display comprising:

data lines;

scan lines;

a pixel unit corresponding to the data lines and the scan lines;

a power supply unit comprising a first power terminal configured to supply a first driving voltage, a second power terminal configured to supply a second driving voltage, and a sustain power terminal configured to supply a sustain voltage to the pixel unit; and a control unit, wherein the pixel unit comprises:

a switching transistor comprising a gate electrode connected to a scan line, an electrode connected to a data line, and another electrode connected to a first node;

a storage capacitor comprising a terminal connected to the first node and another terminal connected to a second node;

a driving transistor comprising a gate electrode connected to the second node, an electrode connected to the first power terminal, and another electrode connected to an organic light emitting diode through a third node;

a first transistor comprising an electrode connected to the second node, and another electrode connected to the third node;

a second transistor comprising an electrode connected to the first node and another electrode connected to the sustain power terminal;

a third transistor comprising an electrode coupled to the first node and another electrode coupled to the first power terminal; and a fourth transistor comprising an electrode connected to the sustain voltage terminal and another electrode connected to at least one of an anode electrode of the organic light emitting diode and the third node, wherein the control unit is configured to turn on the fourth transistor substantially simultaneously with the first and second transistors.

22. An organic light emitting display comprising:

data lines;

scan lines;

a pixel unit corresponding to the data lines and the scan lines;

a power supply unit comprising a first power terminal configured to supply a first driving voltage, a second power terminal configured to supply a second driving voltage, and a sustain power terminal configured to supply a sustain voltage to the pixel unit;

wherein the pixel unit comprises:

a switching transistor configured to apply a data signal to a first node according to a scan signal;

a storage capacitor, connected between the first node and a second node, configured to be charged with a difference voltage of voltages applied to the first and second nodes;

a driving transistor configured to control an amount of current provided from the first power terminal to an organic light emitting diode according to voltage applied to the second node;

a first transistor configured to provide a signal path between the second node and a third node coupled to an electrode of the driving transistor based on a first control signal;

a second transistor configured to apply a sustain voltage to the first node based on the first control signal; and a third transistor configured to apply a driving voltage provided from the first power terminal to the first node according to a second control signal; and a control unit configured to turn on the third transistor in a first period to apply the first driving voltage to the first node, to turn on the second transistor on in a second period that is subsequent to the first period to apply the sustain voltage to the first node, to turn on the switching transistor in a third period that is subsequent to the second period to apply a voltage that corresponds to the data signal to the first node, wherein the first driving voltage is applied to the first node in a fourth period that is subsequent to the third period.

* * * * *